US006172612B1

(12) United States Patent
Odachowski

(10) Patent No.: US 6,172,612 B1
(45) Date of Patent: Jan. 9, 2001

(54) SMOKE DETECTOR WITH REMOTE TESTING, SHUTOFF AND POWERING MEANS

(76) Inventor: Mark Odachowski, 9939 Jerry Mack Rd., Suite 400, Ocean City, MD (US) 21842

( * ) Notice: Under 35 U.S.C. 154(b), the term of this patent shall be extended for 0 days.

(21) Appl. No.: 09/326,359

(22) Filed: Jun. 4, 1999

(51) Int. Cl.[7] ..... G08B 17/00

(52) U.S. Cl. ..... 340/628; 340/577; 340/584; 340/693.2; 340/693.4

(58) Field of Search ..... 340/628, 629, 340/630, 577, 578, 579, 584, 693.2, 693.5, 693.9, 693.11

(56) References Cited

U.S. PATENT DOCUMENTS

| | | | | |
|---|---|---|---|---|
| 3,696,382 | | 10/1972 | Ritttmann | 340/310 |
| 3,952,294 | | 4/1976 | Emerson | 340/237 |
| 4,180,742 | | 12/1979 | Malinowski | 250/574 |
| 4,517,555 | | 5/1985 | Marsocci et al. | 340/522 |
| 4,594,581 | | 6/1986 | Matoba | 340/531 |
| 4,600,314 | | 7/1986 | Theriault | 368/10 |
| 4,785,293 | * | 11/1988 | Shearer et al. | 340/628 |
| 4,788,530 | | 11/1988 | Bernier | 340/527 |
| 4,901,056 | * | 2/1990 | Bellavia et al. | 340/628 |
| 5,283,816 | | 2/1994 | Diaz | 379/40 |
| 5,289,165 | * | 2/1994 | Belin | 340/628 |
| 5,442,336 | | 8/1995 | Murphy et al. | 340/628 |
| 5,574,436 | * | 11/1996 | Sisseiman et al. | 340/628 |
| 5,587,705 | | 12/1996 | Morris | 340/628 |
| 5,594,410 | | 1/1997 | Lucas et al. | 340/332 |
| 5,786,767 | | 7/1998 | Severino | 340/628 |
| 5,815,066 | * | 9/1998 | Pumilia | 340/628 |

* cited by examiner

*Primary Examiner*—Daniel J. Wu
(74) *Attorney, Agent, or Firm*—Larry J. Guffey

(57) ABSTRACT

The present invention discloses improved smoke detector devices. In a preferred embodiment, the invention takes the form of an improved smoke detector of the type having a ceiling-mounted, main housing with an electrical circuit that includes an alarm device and a smoke sensing means that activates the alarm device when smoke is present in the vicinity of the sensing means. Wherein the improvement comprises a remote housing that is remotely disposed from the main housing, with the remote housing having affixed thereto a remote electrical circuit comprising a means for receiving an electrical connection from the main electrical circuit, a means for testing the operating condition of the main electrical circuit, a means for shutting off the alarm device, and a remote battery coupling means that allows a battery for powering the detector to be located in the remote housing. In another embodiment, the invention takes the form of a smoke detector remote unit, for use with a retrofitted, improved smoke detector, for providing the detector with remote testing, shutoff and powering capabilities.

8 Claims, 4 Drawing Sheets

SMOKE DETECTOR WITH REMOTE TESTING, SHUTOFF AND POWERING MEANS

BACKGROUND OF THE INVENTION

1. Field of the Invention

The present invention generally relates to smoke detectors. More particularly, this invention relates to a smoke detector having remote testing, shutoff and powering means.

2. Description of the Related Art

The majority of American households are today fitted with smoke detectors of one type or another. The most simple of such detectors are units that contain some type of sensor that detects the presence of smoke in the vicinity of the unit, a noise- and/or light-generating alarm device that is activated by the sensor, and some type of contact that allows one to check on the general operating condition of the unit. These units may be battery powered or may operate on AC power lines with a battery backup.

To be effective and provide the earliest-possible warning of a fire situation in a dwelling, these units are generally mounted on a dwelling's ceiling and in a passage, hallway, staircase or the like, in a location where there is most likely to be a partial airflow; so that if a fire does occur, smoke will be monitored by the smoke detector, and an alarm given.

The location of such a ceiling-mounted detector often presents a significant problem associated with the difficulty that one encounters in having to climb up to the detector. The reasons why one would climb up to the detector are many, and include: for the purpose of pushing the detector's operating condition test button, replacing a battery or shutting-off the detector after it has gone off due to a false signal. Such false signals often occur when one is cooking or lights a fireplace in the dwelling.

To avoid having to climb up to such detectors, a number of inventions have been developed. For example, U.S. Pat. No. 4,600,314 discloses a smoke detector having a remote unit with a means for temporarily shutting off the detector, including an incorporated timer which returns power to the detector after a set period of time, and a battery coupling means which allows the detector's battery to be mounted at the remote unit. Meanwhile, U.S. Pat. No. 4,788,530 discloses a switching device and an electrical circuit suitable for providing remote shutoff capabilities. Additionally, U.S. Pat. No. 5,442,336 discloses how such remote temporary shutoff capabilities can be achieved with wireless, radio frequency communications.

Despite this prior art, one finds most household still utilizing smoke detectors that do not have remote capabilities. An object of the present invention is to provide an improved smoke detector having sufficient remote capabilities so as to enable it to be accepted by and used in most households, thereby eliminating the problems associated with having one climb up to a ceiling-mounted detector that does not have remote features.

Another object of the present invention is to provide an improved smoke detector that facilitates the operations of shutting-off detector alarms, the testing of the operating condition of the detector, and the changing of a detector's battery.

A still further object of the present invention is to provide a remote unit that allows a conventional smoke detector to be retrofitted so as to provide it with remote testing, shutoff and powering means.

Other objects and advantages of the present invention will become readily apparent as the invention is better understood by reference to the accompanying drawings and the detailed description that follows.

SUMMARY OF THE INVENTION

The present invention is generally directed to satisfying the needs set forth above and the problems identified with prior smoke detectors.

In accordance with one preferred embodiment of the present invention, the foregoing problems can be satisfied by providing an improved smoke detector of the type having a ceiling-mounted, main housing. In this housing there is located a main electrical circuit comprising an alarm device and a smoke sensing means that activates the alarm device when smoke is present in the vicinity of the sensing means. Wherein the improvement comprises a remote housing that is remotely disposed from the main housing, with the remote housing having affixed thereto a remote electrical circuit comprising a means for receiving an electrical connection from the main electrical circuit, a means for testing the general condition of the main electrical circuit, a means for shutting off the alarm device, and a remote battery coupling means that allows a battery for powering the detector to be located in the remote housing.

In another preferred embodiment, the present invention is seen to take the form of a smoke detector remote unit for use with a retrofitted and improved smoke detector so as to provide the detector with remote capabilities. Wherein the improved smoke detector is assumed to be of the type having a main housing and affixed thereto a main electrical circuit comprising an alarm device, a smoke sensing means, a testing means for testing the general operating condition of the main electrical circuit, and a battery coupling means that allows a battery for powering the detector to be located in the main housing.

In this embodiment, the remote unit comprises a remote housing, a remote electrical circuit affixed to the remote housing and comprising a means for receiving an electrical connection with the main electrical circuit, a testing contact that allows one to activate the testing means in order to test the operating condition of the main electrical circuit, a means for shutting off the alarm device, and a remote battery coupling means that allows a battery for powering the detector to be located in the remote housing.

In a still further preferred embodiment, the present invention is seen to take the form of a retrofitted and improved smoke detector that has been retrofitted so as to facilitate its use with remote units such as that described above.

Other embodiments of the present invention will become readily apparent as the invention is better understood by reference to the accompanying drawings and the detailed description that follows.

DESCRIPTION OF THE PREFERRED EMBODIMENT

Figure 1:
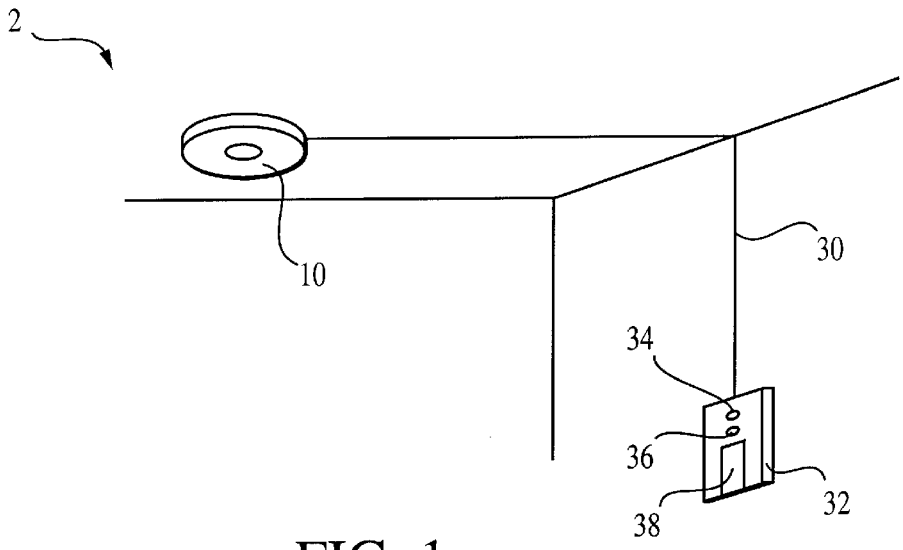
FIG. 1 is a perspective view of an embodiment of the present invention in the form of an improved smoke detector having remote testing, shutoff and powering means.

Referring now to the drawings wherein are shown preferred embodiments and wherein like reference numerals designate like elements throughout, there is shown in FIG. 1 a perspective view of an embodiment of the present invention in the form of an improved smoke detector having remote testing, shutoff and powering means.

In this embodiment, the improved smoke detector 2 is of the type having a ceiling-mounted, main housing 10. The components within this main housing are well known in the art and are shown in the block diagram of FIG. 2 to form a main electrical circuit that consists of a noise- or light-generating alarm device 12 and a fire or smoke sensing means 14 that acts to close the electrical circuit to allow power to flow to the alarm device 12 when smoke is present in the vicinity of the sensing means 14.

Figure 2:
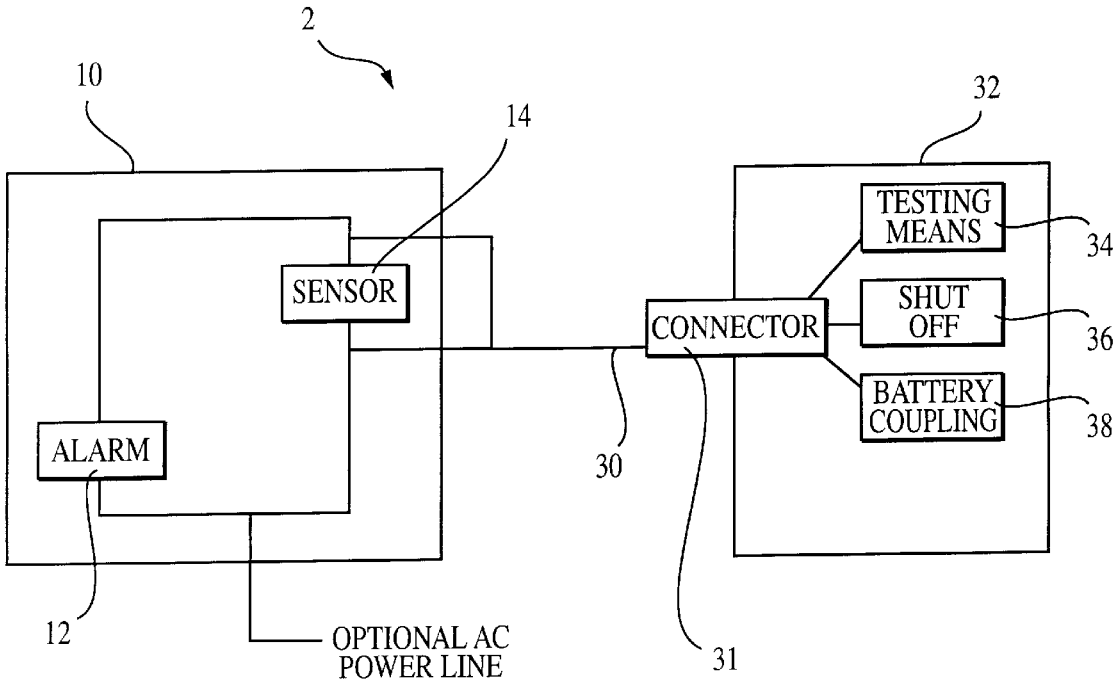
FIG. 2 is a block diagram of the embodiment shown in FIG. 1.

The improvement to this type of smoke detector comprises, as also shown in the block diagram of FIG. 2, an electrical line 30 extending from the ceiling-mounted, main housing 10 to a remote, more-readily accessible, housing 32 into which the line 30 extends and connects with a means for receiving 31 an electrical connection from the main electrical circuit. The remote housing 32 has affixed thereto and connected to the electrical line 30 a remote electrical circuit comprising a means for testing 34, such as a simple mechanical contact in parallel with the smoke sensing means 14, the operating condition of the main electrical circuit, a shutoff means 36 that allows the detector's alarm 12 to be shutoff, such as a simple mechanical switch that opens the electrical circuit between the alarm device 12 and its power source, and a remote battery coupling means 38, such as the male and female connectors that are connected to a conventional dry-cell, nine-volt battery, that allows a battery for powering the detector to be located in the more-readily accessible, remote housing 32.

Many types of fire sensing means 14 are well known in the art. These include fire or smoke detectors of the thermal, ionization, light-scattering, extinction or radiation types.

Figure 7A:
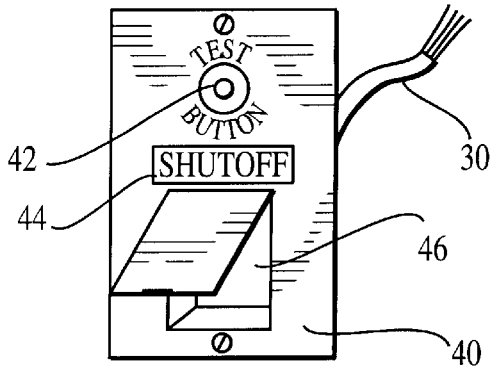
FIGS. 7(*a*)–(*c*) are perspective views of various alternative embodiments of the remote housing for use with the present invention.
Figure 7B:
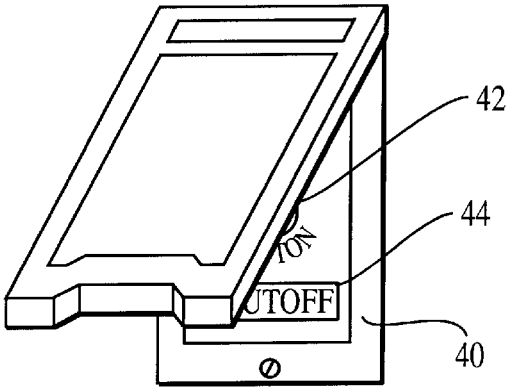
Figure 7C:
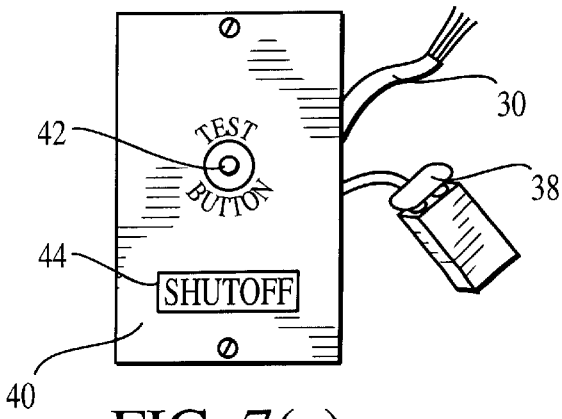

The remote housing 32 for use with the present invention can take many different forms, some of which are shown in FIGS. 7(*a*)–(*c*), and include those that comprise a base 33 which is configured so that it is mountable on the front of a conventional, recess-mounted, electrical box. Such an electrical box is of the type that is often mounted on the side of one of a room's structural members, with the fronts of such structural members being used for holding the materials ( e.g. sheetrock) that make up a room's walls. In this configuration, this base 33 effectively serves as a cover plate 40 that contains testing 42 and shutoff 44 switches, or even an opening 46 that provides access to a battery mounting assembly.

Advantages of this configuration include: (1) it minimizes the degree to which this remote housing extends from the wall to which it is attached, and (2) it incorporates the use of the standards electrical elements that are found in rooms that might need a smoke detector.

Figure 3:
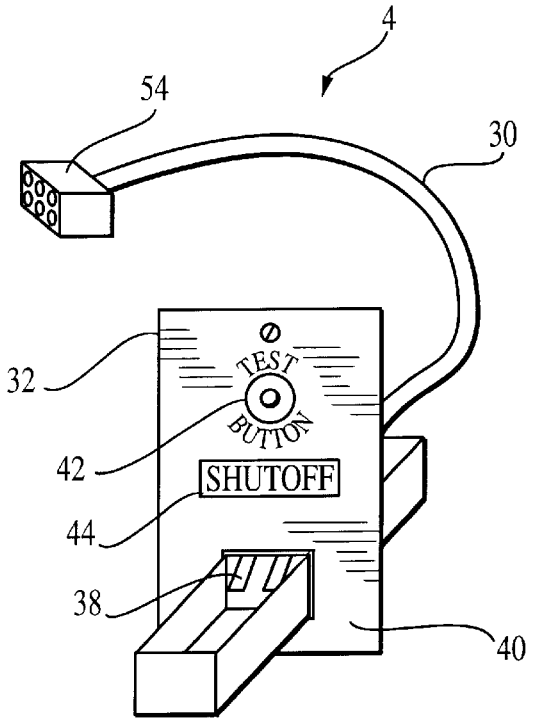
FIG. 3 is a perspective view of an embodiment of the present invention in the form of a remote unit for use with a standard smoke detector so as to provide the detector with remote capabilities.
Figure 4:
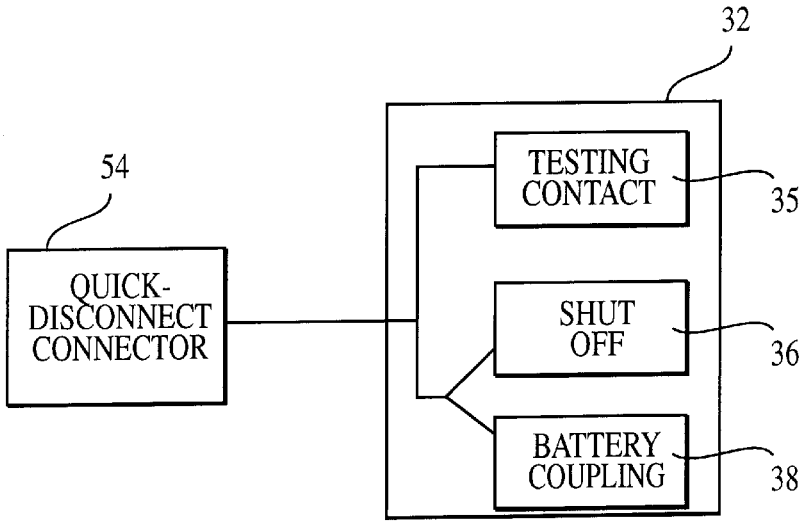
FIG. 4 is a block diagram of the embodiment shown in FIG. 3.

In another preferred embodiment, the present invention is seen to take the form of a remote unit 4, as shown in the perspective view of FIG. 3 and in the block diagram of FIG. 4, for use with a retrofitted and improved, conventional smoke detector 6 so as to provide the detector with remote capabilities. The conventional smoke detector is assumed to be of the type having a main housing 10 with an alarm device 12, a smoke sensing means 14, a testing means 16 for testing the general operating condition of the detector, and a battery coupling means 18 that allows a battery to used as the primary or the back-up power source for the detector.

Figure 5:
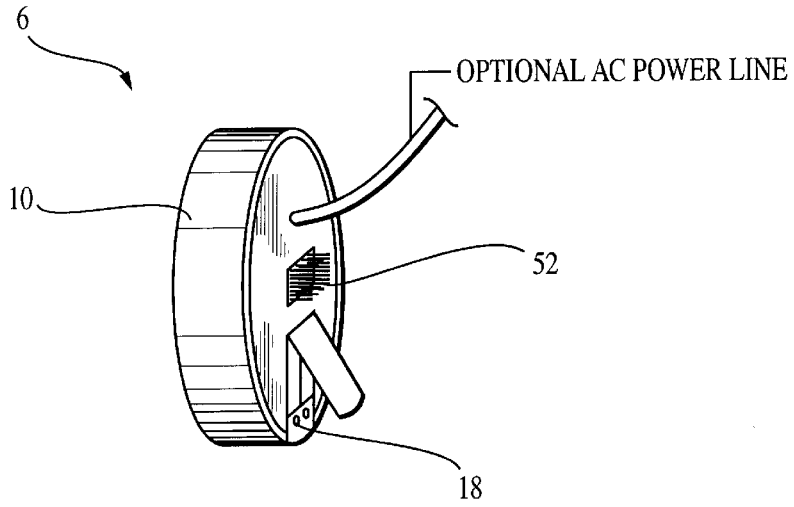
FIG. 5 is a perspective view of an embodiment of the present invention in the form of an improved smoke detector that has been modified so as to facilitate its use with remote units such as shown in FIG. 3.
Figure 6:
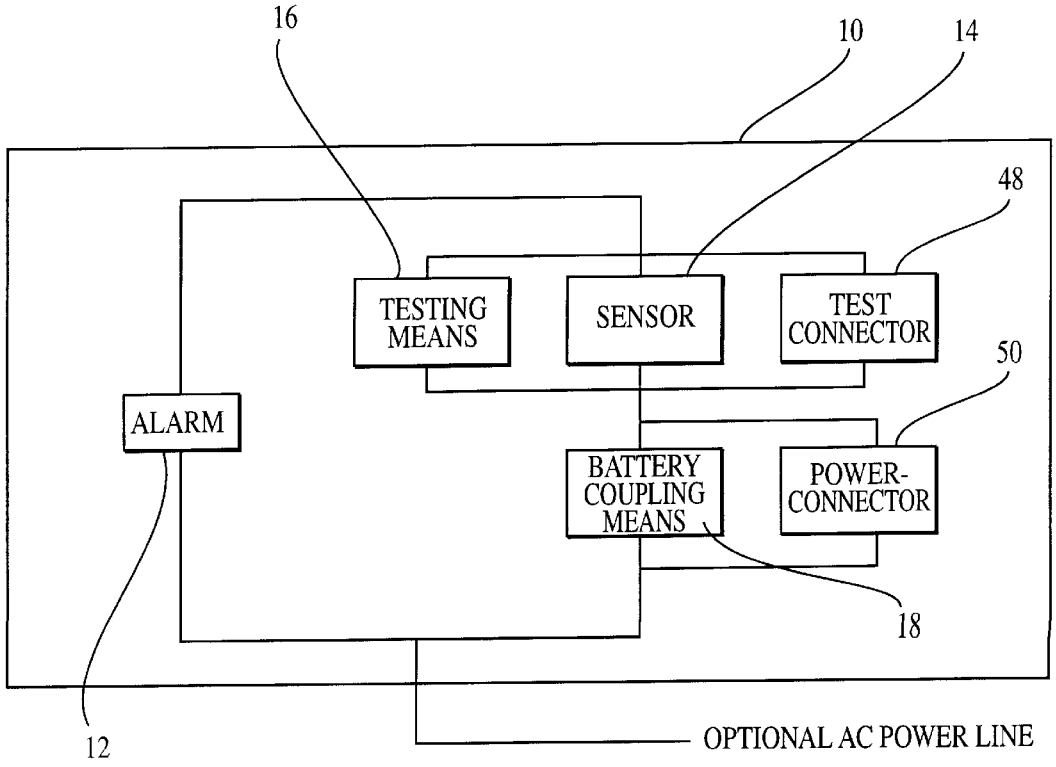
FIG. 6 is a block diagram of the embodiment shown in FIG. 5.

The improvement to the conventional detector, as shown in the perspective view of FIG. 5 and in the block diagram of FIG. 6, consists of the retrofit that provides it with a test 48 and a power 50 connector which, respectively, allow individual parallel connections to be made across the testing means 16 and the battery coupling means 18 of the detector's main electrical circuit. These connectors are represented in FIG. 5 by the connector pins 52 that extend from the rear of the detector's housing 10.

Meanwhile, the remote unit 4 embodiment comprises an electrical line 30 having a test wire that provides a connection across a detector's testing means 16 and a power wire that provides a connection across a detector's battery coupling means 18. This remote unit 4 further includes a remote housing 32 into which the testing and power wires extend, with the remote housing having affixed thereto a testing contact 35 that is connected to the test wire and allows one to activate the testing means 16 in order to test the general operating condition of a detector, a shutoff means 36 that is connected to the power wire and allows a detector's alarm 12 to be shutoff, and a remote battery coupling means 38 that is connected to the power wire and allows a detector's battery to be located in the unit's remote housing 32.

The flexibility of the remote unit embodiment can be further increased by providing a quick-disconnect connector 54 that joins the electrical line 30 that extends from the remote housing 32 to connector pins 52 that extend from the retrofitted and improved detector's main electrical circuit. The advantage of this further addition is that it quickly allows either the main 10 or the remote 32 housing units to be quickly disconnected from the rest of the system and possibly replaced without having to replace the total system.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

I claim:

1. An improved smoke detector of the type having a main housing and affixed thereto a main electrical circuit comprising an alarm device, and a means for detecting smoke that operates to activate the alarm device when smoke is present in the vicinity of the means for detecting smoke, wherein the improvement comprises:

a remote housing that is remotely disposed from said main housing, a remote electrical circuit affixed to said remote housing and comprising a means for receiving an electrical connection with said main electrical circuit, a means for testing the operating condition of said main electrical circuit, a means for shutting off said alarm device, and a remote battery coupling means that allows a battery for powering the detector to be located in said remote housing, and wherein said remote housing comprising a base configured so as to be mountable on the front of a recess-mounted, electrical box.

2. An improved smoke detector of the type having a main housing and affixed thereto a main electrical circuit comprising an alarm device, and a means for detecting smoke that operates to activate the alarm device when smoke is present in the vicinity of the means for detecting smoke, wherein the improvement comprises:

a remote housing that is remotely disposed from said main housing, a remote electrical circuit affixed to said remote housing and comprising a means for receiving an electrical connection with said main electrical circuit, a means for testing the operating condition of said main electrical circuit, a means for shutting off said alarm device, and a remote battery coupling means that allows a battery for powering the detector to be located in said remote housing, an electrical line that connects said remote electrical circuit by a quick-disconnect connector to said main electrical circuit, and said type of detector to which said improvement applies further comprising a pin connector extending from said main electrical circuit for engaging with said quick-disconnect connector.

3. An improved smoke detector as recited in claim 2, wherein said remote housing comprising a base configured so as to be mountable on the front of a recess-mounted, electrical box.

4. A smoke detector remote unit for use with a retrofitted and improved smoke detector so as to provide the detector with remote capabilities, the improved smoke detector being of the type having a main housing and affixed thereto a main electrical circuit comprising an alarm device, a means for detecting smoke that operates to activate the alarm device when smoke is present in the vicinity of the means for detecting smoke, a means for testing the operating condition of the main electrical circuit, a battery coupling means that allows a battery for powering the detector to be located in said main housing, and retrofit improvements comprising a test connector which allows a parallel electrical connection to be made across said testing means and a power connector which allows a parallel electrical connection to be made across said battery coupling means wherein the remote unit comprises:

a remote housing, a remote electrical circuit affixed to said remote housing and comprising a means for receiving an electrical connection with said main electrical circuit, a testing contact that allows one to activate said means for testing the operating condition of said main electrical circuit, a means for shutting off said alarm device, and a remote battery coupling means that allows a battery for powering the detector to be located in said remote housing, an electrical line that connects said remote electrical circuit by a quick-disconnect connector to said main electrical circuit, and the retrofitted and improved smoke detector further comprising a pin connector extending from said test connector and power connector of said main electrical circuit for engagement with said quick-disconnect connector.

5. A smoke detector remote unit as recited in claim 4, wherein said remote housing comprising a base configured so as to be mountable on the front of a recess-mounted, electrical box.

6. A smoke detector remote unit for use with a retrofitted and improved smoke detector so as to provide the detector with remote capabilities, the improved smoke detector being of the type having a main housing and affixed thereto a main electrical circuit comprising an alarm device, a means for detecting smoke that operates to activate the alarm device when smoke is present in the vicinity of the means for detecting smoke, a means for testing the operating condition of the main electrical circuit, a battery coupling means that allows a battery for powering the detector to be located in said main housing, and retrofit improvements comprising a test connector which allows a parallel electrical connection to be made across said testing means and a power connector which allows a parallel electrical connection to be made across said battery coupling means, wherein the remote unit comprises:

a remote housing, a remote electrical circuit affixed to said remote housing and comprising a means for receiving an electrical connection with said main electrical circuit, a testing contact that allows one to active said means for testing the operating condition of said main electrical circuit, a means for shutting off said alarm device, and a remote battery coupling means that allows a battery for powering the detector to be located in said remote housing, wherein said remote housing comprising a base configured so as to be mountable on the front of a recess-mounted, electrical box.

7. An improved smoke detector of the type having a main housing and affixed thereto a main electrical circuit comprising an alarm device, a means for detecting smoke that operates to activate the alarm device when smoke is present in the vicinity of the means for detecting smoke, and a battery coupling means that allows a battery for powering the detector to be located in said main housing, wherein the improvement comprises:

an electrical line having at one end a power connector which allows a parallel electrical connection to be made across said battery coupling means and at the other end a pin connector configured so as to be connected with quick-disconnect connector that extends from a remote unit that provides said detector with remote shutoff and powering capabilities.

8. An improved smoke detector as recited in claim 7, wherein:

said type of detector to which said improvement applies further comprising a means for testing the operating condition of the main electrical circuit, said improvement further comprising a second electrical line having at one end a test connector which allows a parallel electrical connection to be made across said testing means and at the other end a second pin connector configured so as to also be connected with said quick-disconnect connector that extends from said remote unit that also provides said detector with remote testing capabilities.

* * * * *